US007500433B1

(12) United States Patent
Forrester

(10) Patent No.: US 7,500,433 B1
(45) Date of Patent: Mar. 10, 2009

(54) CARTRIDGE APPARATUS

(75) Inventor: David Joel Forrester, Jacksonville, AL (US)

(73) Assignee: Cerberus Institute for Research and Development (Inc.), Warner Robins, GA (US)

( * ) Notice: Subject to any disclaimer, the term of this patent is extended or adjusted under 35 U.S.C. 154(b) by 0 days.

(21) Appl. No.: 08/460,218

(22) Filed: Jun. 2, 1995

Related U.S. Application Data

(62) Division of application No. 08/177,985, filed on Jan. 6, 1994, now Pat. No. 5,479,736.

(51) Int. Cl.
*F42B 7/02* (2006.01)

(52) U.S. Cl. ..... 102/454; 102/457; 102/501; 89/14.6

(58) Field of Classification Search ..... 89/14.6; 102/400, 449, 454, 457, 490, 501, 506, 514, 102/515, 516, 517
See application file for complete search history.

(56) References Cited

U.S. PATENT DOCUMENTS

| | | | | | |
|---|---|---|---|---|---|
| 216,974 | A | * | 7/1879 | Rice | 102/506 |
| 889,644 | A | * | 6/1908 | Szemerey | 102/449 |
| 1,166,879 | A | * | 1/1916 | Alard | 102/400 |
| 1,405,276 | A | * | 1/1922 | Caredgd | 102/400 |
| 4,030,421 | A | * | 6/1977 | Litman | 102/400 |
| 4,167,904 | A | * | 9/1979 | Ferri | 102/457 |
| 4,964,342 | A | * | 10/1990 | Schleicher | 102/521 |

FOREIGN PATENT DOCUMENTS

| | | | | |
|---|---|---|---|---|
| DE | 36248 | * | 8/1886 | 102/501 |
| FR | 854954 | * | 4/1940 | 102/449 |

OTHER PUBLICATIONS

The American Heritage Dictionary of the English Language, "barrel", "cartridge", "divide", "divided", "divisible", pp. 109, 207, 385 . . , 1976.*

* cited by examiner

*Primary Examiner*—J. W Eldred
(74) *Attorney, Agent, or Firm*—James Creighton Wray

(57) ABSTRACT

A cartridge has a shell casing with a primer end and a projectile end. A projectile mounted in the projectile end is made of four segments held together by first and second retainer rings. In one form each segment contains shot. One form of the projectile has an air brake which is deployed as the projectile leaves the muzzle. The air brake is partially deployed or fully deployed, depending of the shredding of third and fourth retainer rings which hold the air brake. When the shredder is inserted in a barrel in a first position, the last horizontal retainer ring is shredded and the air brake is partially deployed. When the shredder blades are further positioned in the barrel, both retainer rings which hold the air brake are shredded and the air brake is fully deployed. Additional positions of the shredder ring first shred the second ring, releasing the segments, and then shred the first retainer ring, releasing the shot and other contents from the segments.

11 Claims, 8 Drawing Sheets

FIG. 4
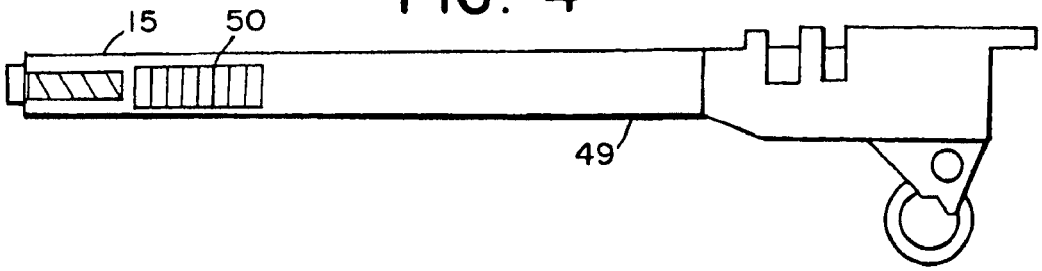
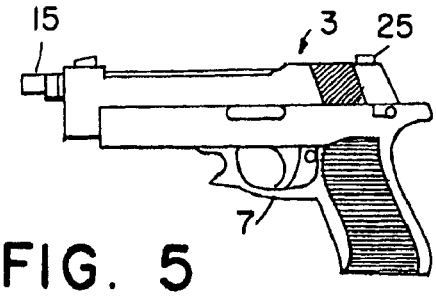
FIG. 5
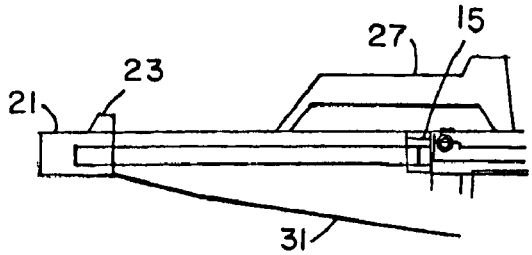
FIG. 6
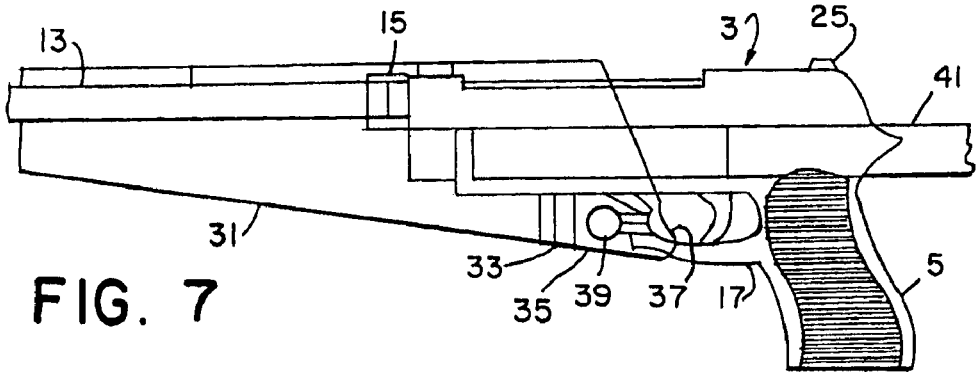
FIG. 7

FIG. 14
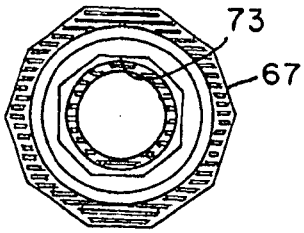
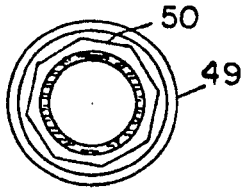
FIG. 15
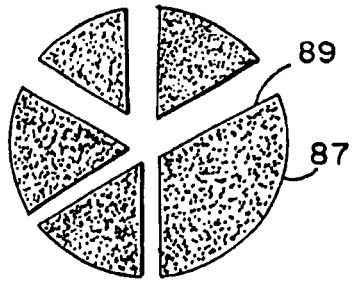
FIG. 18
FIG. 16
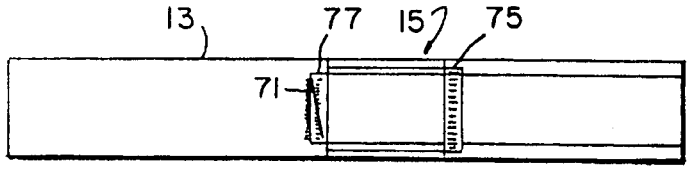

129
131

129
131

139
141
143
137

145
141
143
147

139
145
149
47
27
31
47

CARTRIDGE APPARATUS

This application is a division of application Ser. No. 08/177,985 filed Jan. 6, 1994, now U.S. Pat. No. 5,479,736.

BACKGROUND OF THE INVENTION

This invention relates to firearms, ballistics and ammunition.

In previous existing apparatus gas regulators permit the launching of rifle grenades. Various manufactured pistol shot shells are available. THOMPSON CONTENDER, for example, has manufactured plastic shot shells with a fixed shredder, which has to be removed to fire normal rounds. Barrel attachment methods have been available for a long time. Interrupted screw threads are widely used for takedown rifles, in which barrels may be removed from firing chambers.

A need exists for a low cost modification for service pistols which will make the service pistols responsive to varied needs of law enforcement officers and military soldiers under varied conditions requiring selected responses.

SUMMARY OF THE INVENTION

The present invention provides at reasonable cost a flexibility that allows the user to vary both the nature of the projectile and its velocity without changing ammunition or weapons. That permits the user to engage various targets in varied environments with the same weapon by transforming the service pistol into an assault pistol or carbine.

The new weapons system of the invention is intended for use by law enforcement officers, security agencies and military users. Private shooters may use the limited non-class III systems with 16 inches or longer barrels, shoulder stocks and semi automatic functioning.

The professional firearms field is conservative. By making a service pistol adaptable by simple modifications, tailored for different uses, the invention should cut down on the total number of firearms needed and sold.

The weapons system of the invention includes an adapter system which will convert most large frame automatic pistols into multi-purpose weapons. The invention may be used with COLT M1911A1, BROWNING HP, and the BERETTA 92 series of weapons, for example. The adapter has four levels, each encompassing the previous level or levels, and converts the pistols into four forms. A tactical or target weapon form fires normal ammunition. A second short barreled tactical weapon with a collapsible stock or arm rest is capable of firing normal and augmented service pistol weapons system (ASPWS) ammunition (ASPWSA), with variable power and projectile capability. A third form provides a compact, long barreled assault weapon or carbine. A fourth form is a tri-burst weapon, with grenade launcher function, and silencer. The basic concept of variable power and projectile capability using ASPWSA is adaptable to numerous weapons. For example, a specially designed shotgun would have even more projectile flexibility.

The versatility of the invention weapons system has not been previously achieved with a single weapon. A single, reversible modification of a base weapon enables the attachment of the ASPWS. The modification can be performed in one of three ways, depending on the design of the base weapon and the degree of expense that is acceptable. Three modification options follow.

For pistols as the M1911A1 with a substantial barrel bushing or similar feature, the barrel bushing is replaced.

For pistols where the muzzle of the barrel protrudes or is even with the forward wall of the slide, machining of the barrel precedes addition of a sub adaptor.

For other pistols a new barrel that is approximately 4 cm longer than standard is installed.

Replacement of the barrel bushing is the least expensive. Functionality is best with installation of a new longer barrel. A new barrel provides the most rigid structure. A new, longer and reinforced barrel also permits the use of more powerful propellant charges.

The augmented service pistol weapons system of the invention includes a shroud which is attached at the muzzle of the barrel and through the trigger guard. Paired side pressure retainers are mounted on the slide of the base weapon, and there is an additional pressure attachment at the rear of the base weapon frame. The grenade launcher is simply a 10 or 12 gauge shotgun assembly functioning in a manner similar to an M203 with the availability of special munitions. When not in use, the weapons system of the invention is stored in an inconspicuous pod that can be worn on a standard duty belt or carried by a shoulder strap. Assembly time is less then five seconds for trained personnel and is intended to be possible in the dark and under the stress of a firefight. Large capacity magazines are provided. The weapons system also works with standard magazines.

The invention provides a variable power function. A variable power function valve assembly permits setting of the gas port on the adapter to increase or decrease an amount of propellant gas which is allowed to bleed off. Less gas provides less energy, less impact and less range of the projectile. Previous propellant gas bleed devices were normally concerned with grenade launchers and only had two settings, full and approximately ⅓. The selector of the invention has at least ten settings at 10% intervals. In an urban area or high hazard area such as a fuel depot or on board a pressurized aircraft, the selector is dialed down. Due to the location of the gas valve, the weapon continues to function normally, regardless of the gas setting.

The invention provides a selectable shredding device and divisible ammunition. The ammunition includes a standard cartridge with a typical propellant charge. In one embodiment, the projectile has four plastic pods containing shot. The rounds can consist of any sort of submunition that is suitable for small arms of this caliber. Some examples are marking liquid or dye, lancets, tracer, armor piercing, incendiary, dummy/training, and several other special munitions which are currently under development by the inventor. An additional munitions variant is the mini chain shot, whereby the pods are linked at the base by high tensile micro filaments for high impact probability. Note: in the grenade projector development gas, bomblets and antipersonnel projectiles could also be used. The pods are bound together by friable rings. Over the pods is another layer of plastic contained by two friable rings. That constitutes an air brake. Dependent on the selectable shredding device setting, the air brake is either contained, 50% deployed, fully deployed or discarded. The air brake reduces the velocity and range of the projectile. Preferably the shredder is mounted at the muzzle prior to the muzzle compensator/flash suppressor and silencer adapter. The second level and subsequent levels of the invention have at their muzzles, prior to muzzle compensator, flash suppressors and silencer adapters, the selectable shredding device. Depending upon its setting, the shredder allows passage of standard ammunition or whole new weapons system ammunition. That precludes the need for a safety interlock. There should be no adverse effects from firing a standard round, regardless of the selectable shredding device setting, as the only result is a slight scouring of the external surface of the projectile. The shredder feature, combined with the variable power setting, allows a great deal of flexibility. For special uses ASPWS-A+, (Augmented Service Pistol Weapons System-Ammunition+, with additional propellant, thus the "+" for additional propellant), is provided with a greater propellant charge. For more power, an ASPWS-A-MAG, (Augmented Service Pistol Weapons System-Ammunition-Magnum, with additional propellant such as a rocket booster), ammunition is provided, with a small rocket booster ignites after leaving the barrel and adds approximately 500 feet per second in projectile velocity.

The flexible system of the invention has the advantages of safe live-fire training, armor piercing, reduced danger to bystanders and objects, bird or snake killing, hunting, survival and signalling functions.

The weapons system of the invention fulfills all tactical weapons requirements against non-regular troops at ranges of less than 200 meters.

The invention provides several advantages. Among the economic benefits, one weapon has many uses. In training, one weapon with many uses allows weapons proficiency within a short time. In tactical situations, one weapon with many uses reduces weight and increases ability for appropriate responses. In public relations and political aspects, the weapons system provides a profile as low as possible. It is out of view until needed, thereby reducing tension between law enforcement and citizens. Further, as a single weapon replaces three (pistol, riot gun and assault rifle), this means less initial expense, less training costs, plus greatly reduced security concerns about stored weapons. The new system provides higher safety for the public at savings of tax dollars.

The new weapons system is a practical solution for modern urban use of force situations. A law officer on the ground may use the new weapons system to meet adversaries within the essential constraints of reasonable force and real concern for the public's safety, yet have equivalent or superior fire power at his disposal without giving the appearance of an urban commando.

An augmented service pistol weapons system and ammunition has an extended barrel and an adapter sleeve and mount which supports the barrel and partially surrounds a forward end of the service pistol. Two hinged flaps have inward extending clamps which engage an inside of the front of a trigger guard on the pistol. A turn-to-release locking pin holds the two flaps together as the flaps are closed on the trigger guard. An arm rest extends laterally rearwardly along sides of the pistol and terminates in a curved rearward extension to support the augmented service pistol on an arm of the user. A fifty round magazine replaces the standard pistol handle magazine. Sighting scopes and aiming devices are mounted above the extended barrel, and any target acquisition device (means for small arms) can be utilized. A foregrip is removable and positionable at opposite lateral sides of the extended barrel and below the barrel, thereby accommodating both left and right handed firers. A variable power function assembly surrounds the barrel and allows selected release of gas to slow projectiles. A shredding device near the muzzle shreds bands on the projectile. A valve on the variable power adjustment releases propellant gas from the barrel and sends the propellant gas forward to the flash suppressor on the muzzle. A shredder immediately before the flash suppressor extends blades and triangular points into the barrel to shred rings which hold shot-filled segments and deployable air brakes in a projectile, depending upon the setting. A case which is attachable to a service belt holds the mount and extended barrel and scope and aiming devices, and three fifty round magazines, for rapid attachment to a service pistol.

An augmented service pistol weapons system has a barrel adapter for connection to a pistol barrel. A barrel extension is connected to the adapter sleeve. Sides enclose a portion of a pistol, and hinged flaps are connected to the sides for engaging a pistol trigger guard and locking the barrel extension housing on the trigger guard.

A two-part locking pin extends through the flaps and has a fixed portion mounted in one flap, and a twistable portion mounted in the other flap. A return spring returns the pin to engaged position and holds the flaps in clamping relation with the trigger guard.

The sides have a trigger guard clamp extending into the trigger guard.

The sides of the weapons system extend around a forward portion of a pistol barrel for controlling barrel pressures.

An arm rest extends rearward from the attachment along sides of the pistol and terminates rearwardly in a curved end, with an additional locking point.

A foregrip is connectable to the mounting attachment for extending perpendicularly from opposite sides of the extended barrel or below the extended barrel a sight at a distal end.

The muzzle end of the pistol barrel is externally threaded, and the adapter is threaded onto the threaded muzzle end.

The threaded muzzle end has interrupted male threads. The adapter sleeve has a turnable locking nut forced toward and onto the threads by an auto installation spring. The pistol barrel and extended barrel have facing recesses. Replaceable soft alloy seals are positioned in the recesses. These seals can be manufactured to have a predetermined life span as a security against an augmented service pistol falling into the wrong hands.

The extended barrel has a variable power function assembly on the barrel. The variable power function assembly has a turnable dial extending around the extended barrel, and has a valve connected to the dial for turning and valving propellant gas from the barrel into a vent tube in varied amounts according to the dial position.

A selective shredding device is connected to the extended barrel. The selective shredding device has a dial surrounding the barrel for turning and urging levers toward and away from the barrel, and the levers have blades and points extendable into the barrel for shredding encircling retainer rings on a projectile.

A cartridge has a standard casing with a primer end (note the system can also be utilized in caseless weapons systems), and a projectile with axially divisible segments and retainer rings for surrounding the segments for holding the segments together.

The segments are solid or hollow and have shot, liquid, lancets, etc. held within the segments for releasing the contents as the segments are released from the extended barrel.

An air brake is positioned on the projectile and a nose portion. A trailing portion is surrounded by a deployable air brake and held inward by a band, for deploying the air brake as the band is shredded.

A case for holding the augmented service pistol weapons system has a bottom section with attachments for connecting to a service belt. A cavity holds the extended barrel and the extended barrel mounting means, and aiming devices and scopes and separate increased cartridge magazines.

These and further and other objects and features of the invention are apparent in the disclosure, which includes the above and ongoing written specification, with the claims and the drawings.

BRIEF DESCRIPTION OF THE DRAWINGS

Only a level II augmented service pistol is depicted.

FIG. 4 is a side elevation of a barrel extension modification.

FIG. 5 is a detail showing the barrel extension modification on a pistol.

FIG. 6 is a side elevational detail of a barrel extension modification and a barrel, sight aiming scope and handle.

FIG. 7 is a side elevational view of a pistol and the barrel extender showing the locks.

FIG. 14 is an end view of the extended barrel shown in FIG. 13.

FIG. 15 is an end view of the modified pistol barrel shown in FIG. 12.

FIG. 16 is an assembled detail of the pistol barrel end and extended barrel.

FIG. 18 is an enlarged detail of a vent valve used in the assembly shown in FIG. 17.

DETAILED DESCRIPTION OF THE DRAWINGS

Figure 1:
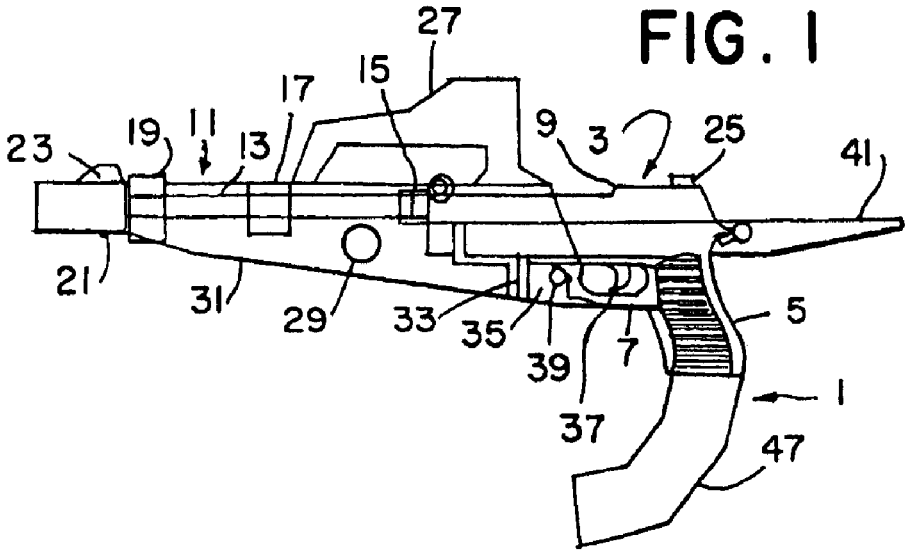
FIG. 1 is a side elevation of an augmented service pistol weapons system of the invention.
Figure 2:
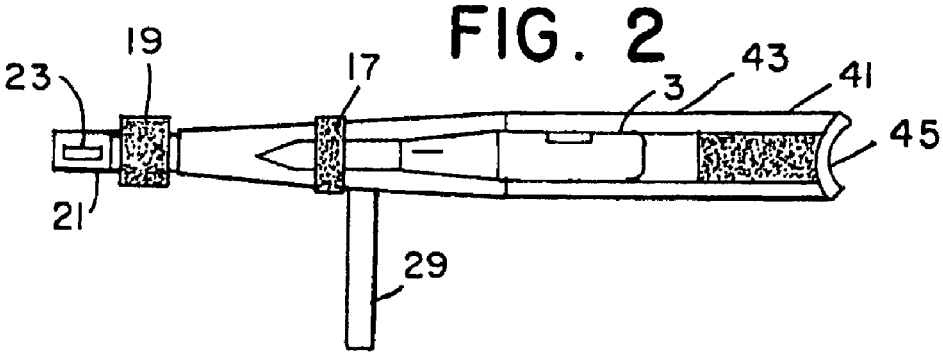
FIG. 2 is a plan view of the augmented service pistol weapons system shown in FIG. 1.
Figure 3:
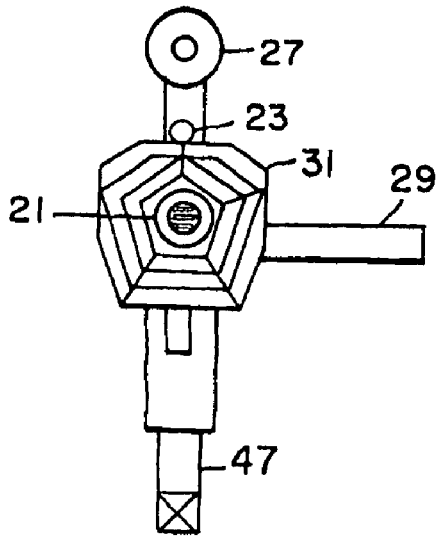
FIG. 3 is a muzzle end view of the augmented service pistol weapons system.

Referring to FIGS. 1-3, an augmented service pistol weapons system is generally indicated by the numeral 1. The pistol weapons system includes a pistol 3 with a handle 5, trigger guard 7 and slide 9. An extended barrel mounting assembly, generally indicated by the numeral 11, is attached to the pistol. The extended barrel option includes a barrel extension 13 connected to the pistol barrel by a barrel adapter sleeve 15, and a variable power function assembly 17 on the barrel extension 13.

A selective shredder assembly 19 is mounted on the barrel 13, and a flash suppressor 21 is mounted on the muzzle of the barrel. The front of the barrel includes a front sight 23, which cooperates with the rear sight 25 on the pistol. A combination handle and scope or laser aiming device 27 is mounted on the extended bearing housing 31. A foregrip 29 is mounted on the housing 31. As will later be described, two vertical hinges 33 support swingable side portions 35 with grips 29 which capture the front part of the trigger guard, and a locking pin 39 which locks the swingable locking plates 35 in trigger guard gripping position.

As shown in the plan view of FIG. 2, the weapons system is a compact apparatus for quickly attaching to a service pistol 3.

The mounting 31 extends along the front of the pistol 3.

The arm rest 41 extends 43 along both sides of the pistol 3. A curved rear surface 45 rests against the arm of a user.

A fifty round magazine 47 extends the magazine of a normal service pistol.

As shown in the end view of FIG. 3, the foregrip 29 may be placed in one of three optional positions.

FIGS. 4, 5 and 6 are details of a barrel extension. The existing barrel is reduced in diameter and is threaded 50 to accept the adapter sleeve 15.

Figure 11:
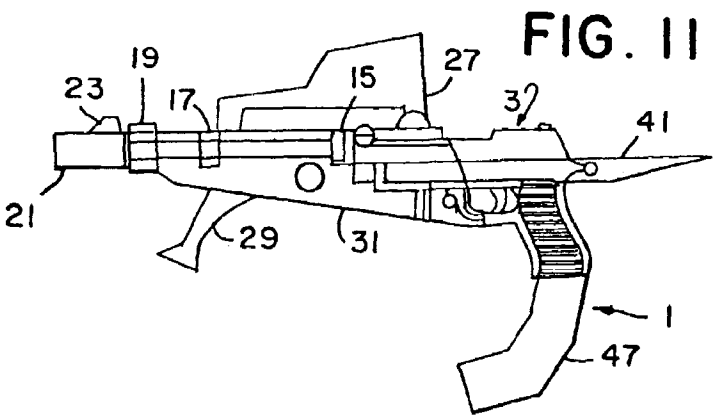
FIG. 11 is a side elevational view of one handle and sight modification, an increased magazine and an arm rest.
Figure 12:
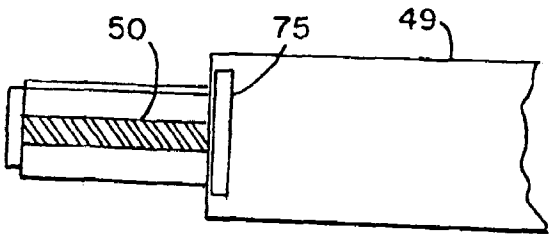
FIG. 12 is a detail of a pistol mounted barrel connector.
Figure 13:
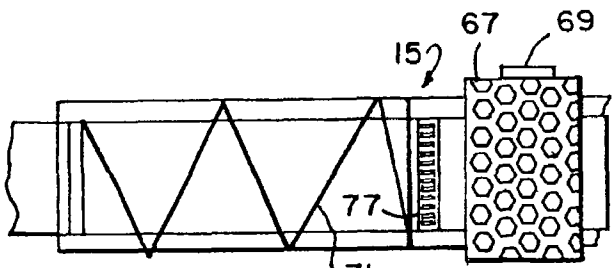
FIG. 13 is a schematic view of the extended barrel and connector.

FIGS. 7 and 11 are details of augmented service pistol weapons systems 1.

Figure 8:
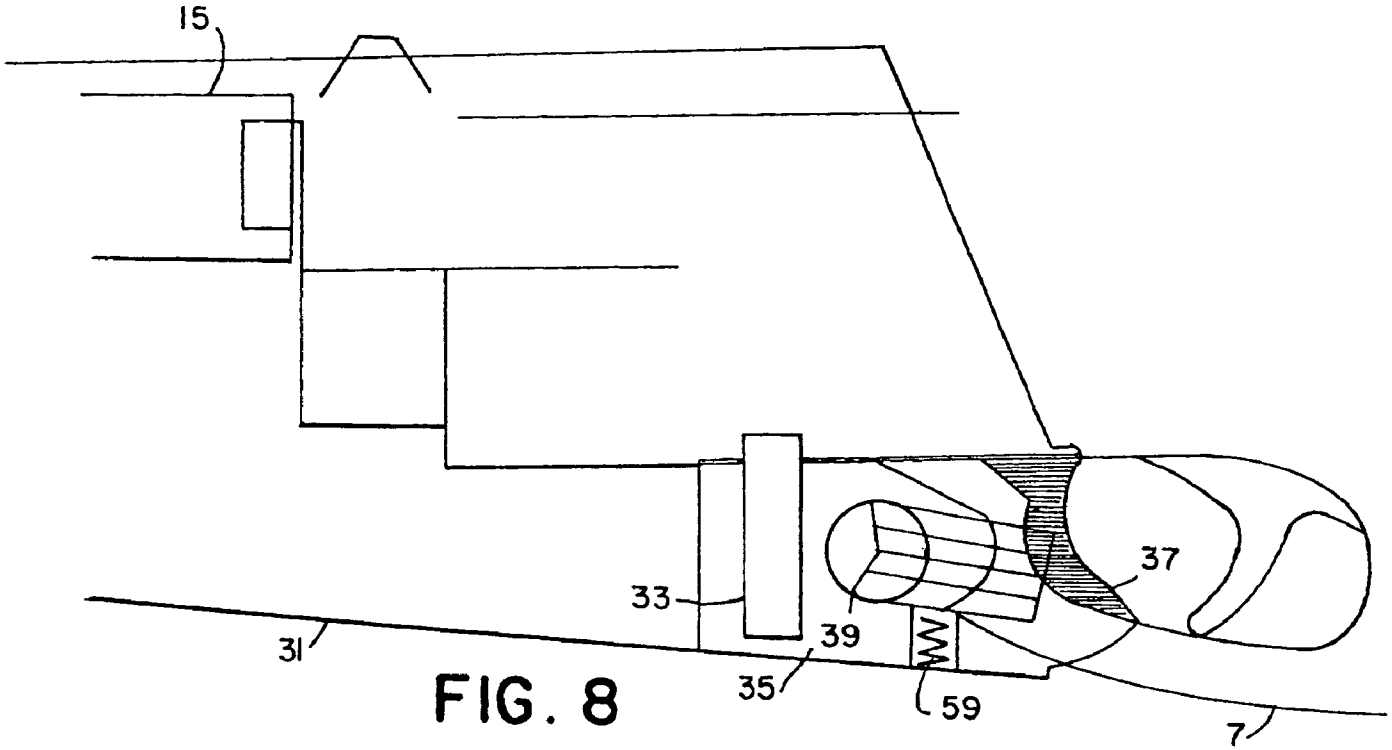
FIG. 8 is a side elevational detail of the trigger guard clamp and locks.

FIG. 8 shows a detail of the trigger guard clamp 37, which clamps around the trigger guard 7 after swinging inward on hinges 33 and being held in place by locking pin 39.

Figure 10:
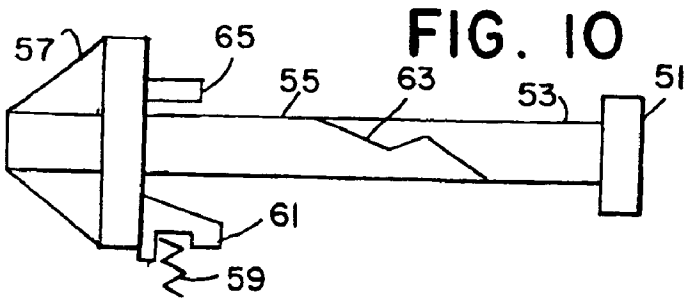
FIG. 10 is a detail of the locking pin.
Figure 9:
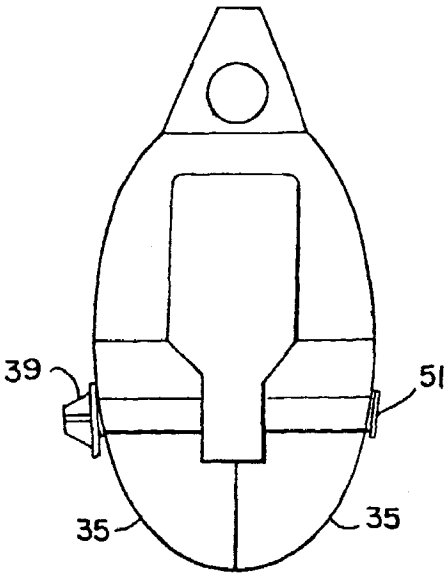
FIG. 9 is an end elevational detail of the locks and locking pin.

FIG. 9 shows a front view of the clamping side portions 35 and the locking pin 39. As shown in FIGS. 9 and 10, the locking pin has a fixed head 51 which is held inside one of the sides 35, and a fixed pin portion 53 which extends inward and engages with turnable pin portion 55. A handle 57 allows the pin to turn, and a return spring 59 in housing 61 twists the movable shaft portion 55 back into locking engagement with the interface 63. A stop 65 limits rotation of the knob 57.

FIGS. 12-16 show preferred adapters. The existing pistol barrel 49 is reduced and threaded with interrupted male threads 50, which are schematically shown in FIG. 15. The connector sleeve 15 has a locking nut 67, with a knurled surface and a detent retention button 69. An auto installation spring 71 drives the locking nut axially and circumferentially into engagement with the threads 50. The locking nut has internal threads 73, which mate with the interrupted thread 50 on the pistol barrel.

Replaceable soft alloy seals 75 and 77 are mounted in recesses in the pistol barrel and in the extension barrel 13.

Figure 17:
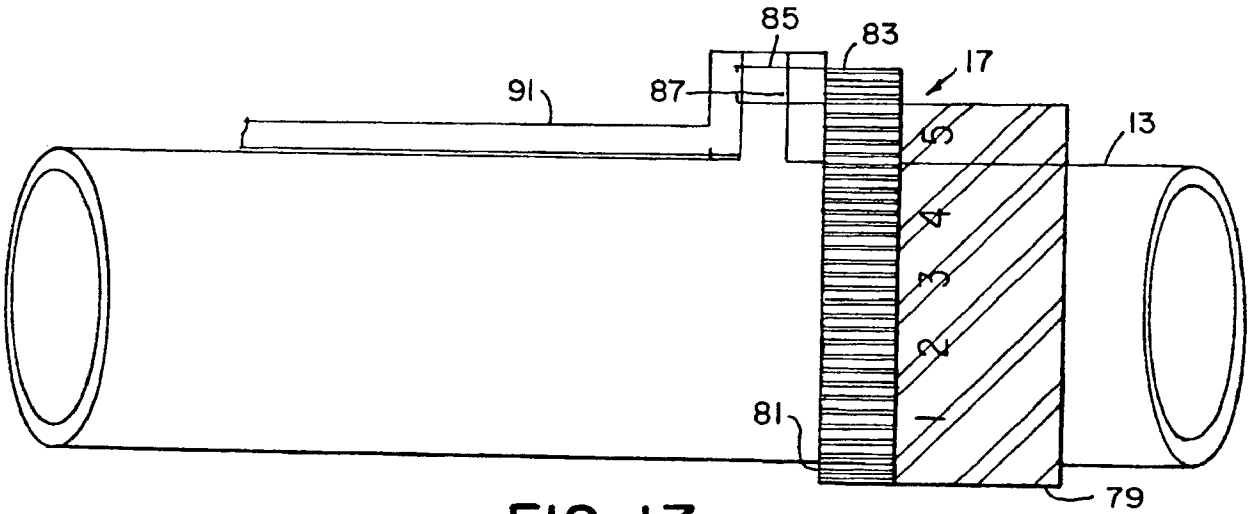
FIG. 17 is a side elevational detail of a variable power function assembly used with the present invention.

As shown in FIGS. 17 and 18, a variable power function assembly 17 is mounted on the barrel extension 13. The assembly has a six or ten position dial 79 connected to a large gear 81 which turns a small gear 83, which is connected via shaft 85 to the variable release valve 87, as shown in FIG. 18.

Depending on which of the channels 89 are communicated with the barrel extension 13, an amount of gas is released into the vent tube 91 and is directed to the flash suppressor.

Figure 20:
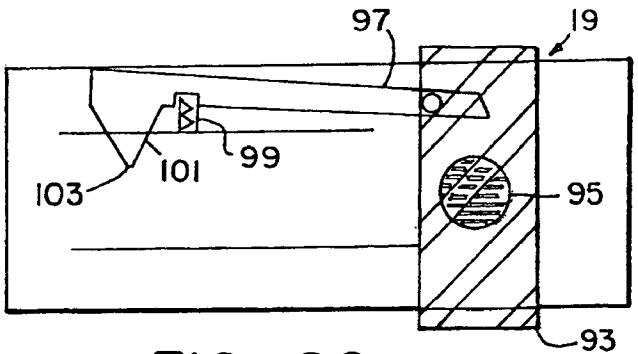
FIG. 20 is a side elevational schematic view of the shredding device shown in FIG. 19.
Figure 19:
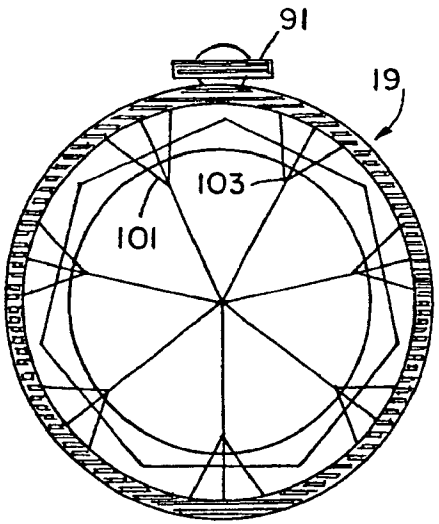
FIG. 19 is an end view of a selective shredding device used in the present invention.
Figure 21:
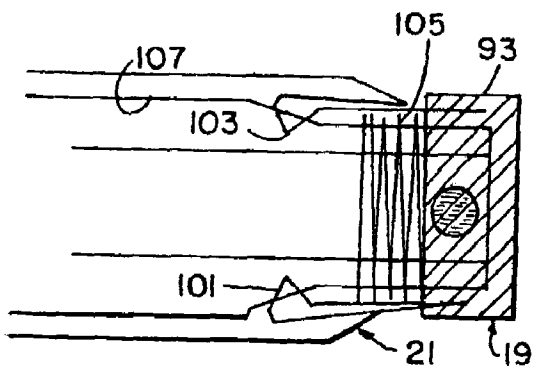
FIG. 21 is a partial sectional view of the shredding device shown in FIGS. 19 and 20.
Figure 23:
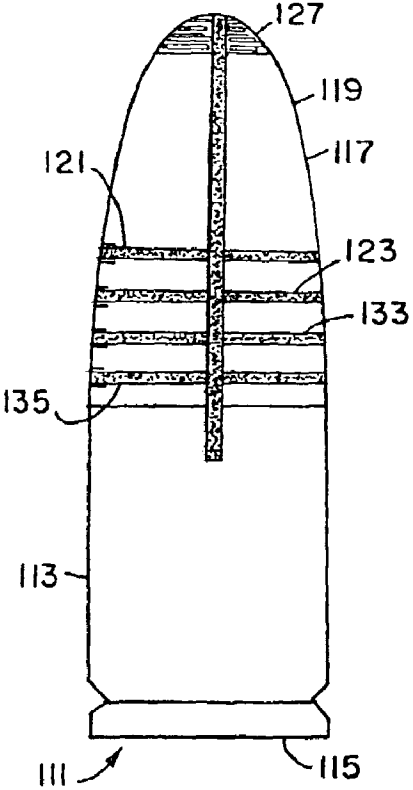
FIG. 23 is a side elevational detail of an ammunition cartridge of the present invention.

A selective shredding device 19 is shown in FIGS. 19, 20 and 21. As shown in FIG. 20, the shredder has a turnable five position dial 93 with a retention button 95. Turning the dial moves levers 97 in and out around the spring mounted fulcrums 99, and advances or retracts the shredder blades 101 and points 103 into or out of the barrel extension 13.

The individual spring fulcrums 99 may be replaced by a large coil spring 105 which surrounds the barrel, as shown in FIG. 21. The shredder blades 101 and points 103 extend into an enlarged area 107 in the barrel extension 13. Turning the dial 93 advances or retracts the points 103 to shred a first ring of an air brake, or to shred first and second rings of an air brake. Further advancement shreds the rings which hold the segments, as will further be described.

The vent tube 91 from the variable power function assembly 17 is shown at the top of dial 93 in FIG. 19.

Figure 22:
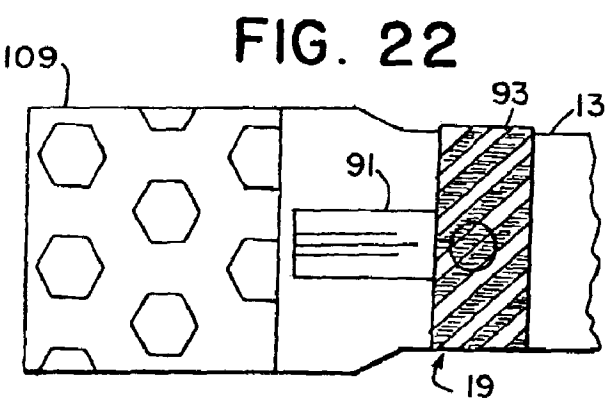
FIG. 22 is a partial side elevational detail of a flash suppressor, muzzle compensator and selective shredding device at a muzzle of the extended barrel.

As shown in FIG. 22, the flash suppressor muzzle compensator 109 is an enlarged end on the end of the barrel extension 13 beyond the dial 93 of the shredding device 19.

In FIGS. 23-29, the preferred cartridge 111 is shown. The cartridge has a shell casing 113 with a primer end 115, and has a projectile 117 made of four segments 119 held together by retainer rings 121 and 123.

Figure 25:
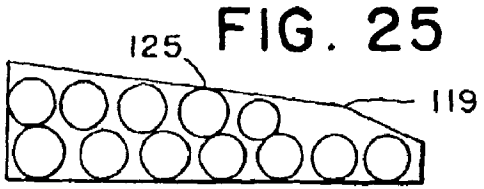
FIG. 25 is a side elevational detail of a segment section shown partially in cross-section.
Figure 27:
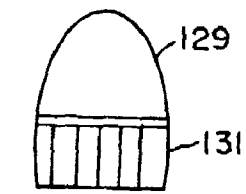
FIG. 27 is a side elevational detail of an air brake.
Figure 26:
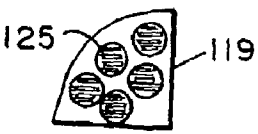
FIG. 26 is an end elevational detail shown partially in cross-section of the segment shown in FIG. 25.
Figure 24:
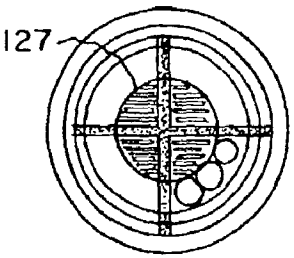
FIG. 24 is an end elevation of the cartridge shown in FIG. 23.

As shown in FIGS. 25 and 26, each segment contains shot 125. Alternatively the segments may be solid.

Figures 28, 29, 30, 31, 32:
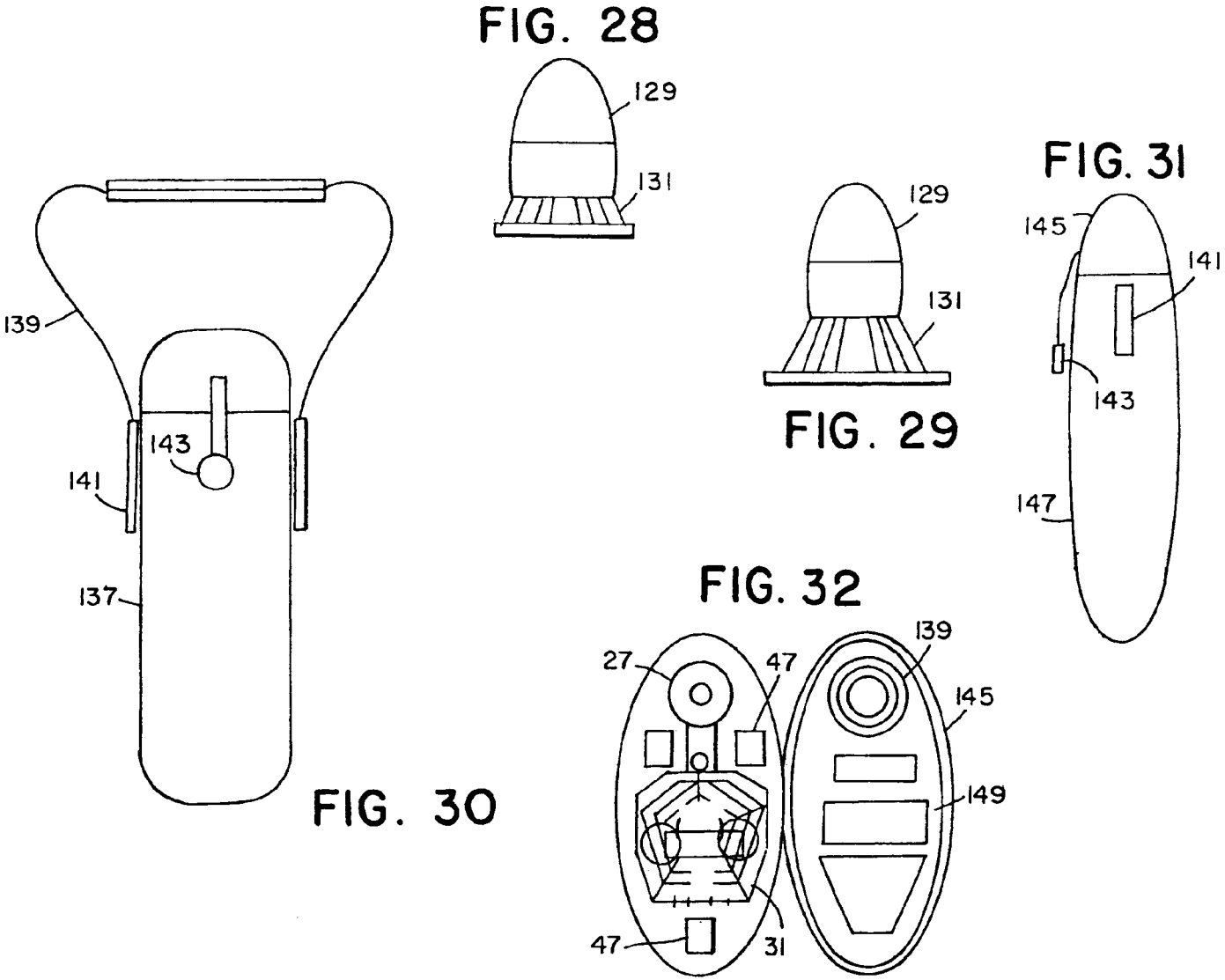
FIG. 28 is a detail of a partially deployed air brake of the projectile shown in FIG. 27.
FIG. 29 is a fully deployed air brake detail of the projectile shown in FIG. 27.
FIG. 30 is a side elevational detail of a case for carrying the weapons system of the invention.
FIG. 31 is an end elevational detail of the case shown in FIG. 30.
FIG. 32 is a schematic representation top view of the case shown in FIGS. 30 and 31 in open condition.

A retainer cap 127 is positioned over the segments. One shell cartridge 129 has an air brake 131 which is deployed as the cartridge leaves the muzzle. FIG. 28 shows the air brake 131 partially deployed, and FIG. 29 shows the air brake fully deployed.

Horizontal retainer rings 133 and 135 hold the air brake.

The pods or segments are held together by friable rings. Over the pods or segments is another layer of plastic contained by friable rings. That constitutes an air brake. Dependent on the selectable shredding device setting, the air brake is either contained, 50% deployed, fully deployed or discarded. The air brake reduces the velocity and range of the projectile.

In one embodiment, retainer rings protrude from the projectile in graduated amounts so that one, two, three or four rings may be selectively cut. In another embodiment, the shredder is loosely or tightly held so that passage of the rings slits the rings and lifts the shredders to a predetermined amount controlled by turning the ring.

If the shredder is inserted in the barrel in a first position, the horizontal retainer ring 135 is shredded and the air brake 131 is partially deployed as shown in FIG. 28. If the shredder blades are further positioned in the barrel, both rings 133 and 135 are shredded and the air brake is fully deployed. Additional positions of the shredder first shred ring 123, releasing the segments and discarding the air brake, and then shred ring 121, releasing shot and other contents from the segments.

The segments 119 may be solid or hollow with shot, liquid, lancets, etc. Upon entering the shredder, horizontal rings are broken, releasing the air brake, the segments or the contents, depending on the setting of the shredder. Thus a single round can be deployed as a solid projectile, four submunitions, or various other sub-submunitions, all at the velocity of choice.

As shown in FIGS. 30-32, the entire augmented service pistol weapons system is carried in a case 137 with a shoulder sling 139. The shoulder sling may be tucked downward, and the case may be carried on the service belt by attachment at loops 141. A snap 143 secures the cover 145 on the case bottom 147.

As shown in FIG. 32, the sling 139 is coiled within the top of the case. The entire augmenting unit is mounted within the case, and fifty round magazines 47 are packed around the augmented service pistol weapons system 1.

The top 145 holds a manual 149 and has recesses for the weapons system.

While the invention has been described with reference to specific embodiments, modifications and variations of the invention may be constructed without departing from the scope of the invention, which is defined in the following claims.

I claim:

1. A cartridge apparatus comprising a cartridge having a casing with a primer end and a projectile end, and having a projectile with axially divisible segments and retainer rings for surrounding the segments for holding the segments together, further comprising a deployable air brake positioned on the projectile, and the projectile having a first portion and a second portion, the second portion being surrounded by the deployable air brake and at least one band for holding the deployable air brake inward.

2. The apparatus of claim 1, wherein the segments are hollow and have contents held within the segments for releasing the contents as the segments are released from a barrel.

3. A cartridge apparatus comprising a cartridge having a casing with a primer end and a projectile end, and having a projectile with a front portion and a trailing portion, a deployable air brake positioned on the trailing portion and held inward until the projectile is released from a barrel, further comprising the projectile having segments held together by friable bands and a shredder provided on the barrel wherein the bands are breakable by the shredder for releasing the segments for independent movement from a muzzle end of the barrel.

4. The apparatus of claim 3, further comprising a band surrounding the air brake and holding the air brake inward, a slitter provided on the barrel for dividing the band and for deploying the air brake as the projectile is released from the barrel.

5. The apparatus of claim 3, wherein the projectile has divisible segments.

6. The apparatus of claim 5, further comprising retainer: rings for surrounding the segments for holding the segments together.

7. The apparatus of claim 5, wherein the segments are hollow and have contents held within the segments for releasing the contents as the segments are released from the barrel.

8. A cartridge apparatus comprising a cartridge having a casing with a primer end and a projectile end, and having a projectile with axially divisible segments, wherein the segments are hollow and have contents held within the segments, said segments being separable when released from a barrel, and wherein the contents of the segments are released when the segments separate after release from the barrel, further comprising a deployable air brake positioned on the projectile, and the projectile having a nose portion and a trailing portion, the trailing portion having the deployable air brake.

9. The apparatus of claim 8, further comprising retainer rings for surrounding the segments for holding the segments together.

10. The apparatus of claim 8, further comprising a retainer band, wherein the air brake is held inward by the band, for deploying the air brake as the band is shredded by a shredder in the barrel.

11. A cartridge apparatus comprising a cartridge having a casing with a primer end and a projectile end, and having a projectile with axially divisible segments, wherein the segments are hollow and have contents held within the segments, said segments being separable when released from a barrel, and wherein the contents of the segments are released when the segments separate after release from the barrel, further comprising friable bands around the projectile, wherein the segments are held together by the friable bands which are breakable by the shredder for releasing the segments for independent movement from the muzzle end.

* * * * *

UNITED STATES PATENT AND TRADEMARK OFFICE

CERTIFICATE OF CORRECTION

PATENT NO. : 7,500,433 B1
APPLICATION NO. : 08/460218
DATED : March 10, 2009
INVENTOR(S) : Forrester It is certified that error appears in the above-identified patent and that said Letters Patent is hereby corrected as shown below:

The title page should be deleted and substitute therefor the attached title page.

Signed and Sealed this

Eighteenth Day of August, 2009

David J. Kappos

David J. Kappos
*Director of the United States Patent and Trademark Office*

(12) United States Patent
Forrester

(10) Patent No.: US 7,500,433 B1
(45) Date of Patent: Mar. 10, 2009

(54) AUGMENTED SERVICE PISTOL AND AMMUNITION WEAPONS SYSTEM

(75) Inventor: David Joel Forrester, Jacksonville, AL (US)

(73) Assignee: Cerberus Institute for Research and Development (Inc.), Warner Robins, GA (US)

( * ) Notice: Subject to any disclaimer, the term of this patent is extended or adjusted under 35 U.S.C. 154(b) by 0 days.

(21) Appl. No.: 08/460,218

(22) Filed: Jun. 2, 1995

Related U.S. Application Data

(62) Division of application No. 08/177,985, filed on Jan. 6, 1994, now Pat. No. 5,479,736.

(51) Int. Cl.
*F42B 7/02* (2006.01)

(52) U.S. Cl. ..... 102/454; 102/457; 102/501; 89/14.6

(58) Field of Classification Search ..... 89/14.6; 102/400, 449, 454, 457, 490, 501, 506, 514, 102/515, 516, 517
See application file for complete search history.

(56) References Cited

U.S. PATENT DOCUMENTS

| | | | | | |
|---|---|---|---|---|---|
| 216,974 | A | * | 7/1879 | Rice | 102/506 |
| 889,644 | A | * | 6/1908 | Szemerey | 102/449 |
| 1,166,879 | A | * | 1/1916 | Alard | 102/400 |
| 1,405,276 | A | * | 1/1922 | Caredgd | 102/400 |
| 4,030,421 | A | * | 6/1977 | Litman | 102/400 |
| 4,167,904 | A | * | 9/1979 | Ferri | 102/457 |
| 4,964,342 | A | * | 10/1990 | Schleicher | 102/521 |

FOREIGN PATENT DOCUMENTS

| | | | | |
|---|---|---|---|---|
| DE | 36248 | * | 8/1886 | 102/501 |
| FR | 854954 | * | 4/1940 | 102/449 |

OTHER PUBLICATIONS

The American Heritage Dictionary of the English Language, "barrel", "cartridge", "divide", "divided", "divisible", pp. 109, 207, 385 . . , 1976.*

* cited by examiner

*Primary Examiner*—J. W Eldred
(74) *Attorney, Agent, or Firm*—James Creighton Wray

(57) ABSTRACT

A cartridge has a shell casing with a primer end and a projectile end. A projectile mounted in the projectile end is made of four segments held together by first and second retainer rings. In one form each segment contains shot. One form of the projectile has an air brake which is deployed as the projectile leaves the muzzle. The air brake is partially deployed or fully deployed, depending of the shredding of third and fourth retainer rings which hold the air brake. When the shredder is inserted in a barrel in a first position, the last horizontal retainer ring is shredded and the air brake is partially deployed. When the shredder blades are further positioned in the barrel, both retainer rings which hold the air brake are shredded and the air brake is fully deployed. Additional positions of the shredder ring first shred the second ring, releasing the segments, and then shred the first retainer ring, releasing the shot and other contents from the segments.

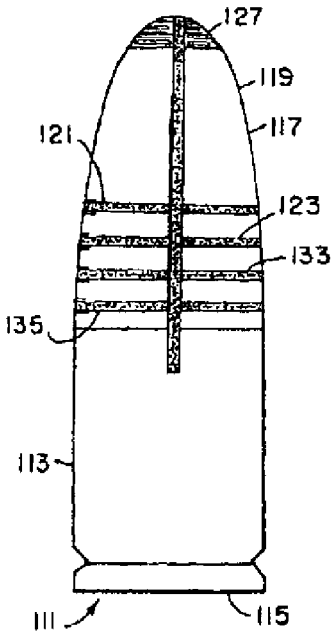

11 Claims, 8 Drawing Sheets